United States Patent [19]

Levitas

[11] Patent Number: 4,801,010

[45] Date of Patent: Jan. 31, 1989

[54] GARMENT BAG WITH STRAP TO SECURE CLOSURE FLAP IN BUNDLED CONFIGURATION

[76] Inventor: Miriam S. Levitas, 720 W. Conway Dr., Atlanta, Ga. 30327

[21] Appl. No.: 68,546

[22] Filed: Jul. 1, 1987

[51] Int. Cl.[4] ..... A45C 3/00; A45C 13/10; A45C 13/30; B65D 85/18

[52] U.S. Cl. ..... 206/279; 206/282; 206/287.1; 206/292; 190/110; 190/111; 190/113

[58] Field of Search ..... 206/278, 279, 282, 286, 206/287, 287.1, 289, 290; 190/109, 13 B, 110, 111, 113, 112

[56] References Cited

U.S. PATENT DOCUMENTS

| | | | |
|---|---|---|---|
| 1,832,715 | 11/1931 | London | 206/287 |
| 2,003,100 | 5/1935 | Arpin | 206/287.1 X |
| 2,087,211 | 7/1937 | Marbury et al. | 206/287.1 X |
| 2,154,630 | 4/1939 | Marbury et al. | 206/287.1 X |
| 2,596,412 | 5/1952 | Kish, Jr. et al. | 206/287.1 X |
| 3,115,959 | 12/1963 | Jaffe | 206/287.1 |
| 3,139,164 | 6/1964 | Koffler | 206/287.1 X |
| 3,221,848 | 12/1965 | O'Neil | 206/287.1 X |
| 3,542,170 | 11/1970 | Bialo | 206/287.1 X |
| 3,559,777 | 2/1971 | Gardner | 206/279 |
| 3,572,251 | 3/1971 | Johnson | 206/290 X |
| 4,244,453 | 1/1981 | Herz | 206/287 X |
| 4,489,829 | 12/1984 | Myers et al. | 206/287 X |
| 4,598,803 | 7/1986 | Ghiassi | 206/287.1 X |

*Primary Examiner*—Sue A. Weaver

*Attorney, Agent, or Firm*—Thomas & Kennedy

[57] ABSTRACT

A garment bag that may serve as a portable wardrobe comprises flexible front, back and side panels which define a compartment for containing articles of clothing and accessories. The front panel has a flap adapted to be rolled and stored in the bottom of the garment bag. The garment bag is provided with pockets that are accessible from inside the bag with the flap in its stowed position.

6 Claims, 3 Drawing Sheets

GARMENT BAG WITH STRAP TO SECURE CLOSURE FLAP IN BUNDLED CONFIGURATION

TECHNICAL FIELD

The present invention relates generally to luggage and particularly to garment bags.

BACKGROUND OF THE INVENTION

Garment bags adapted to be folded and carried have been available for some time. Many of these bags, such as those illustrated in U.S. Pat. No. 3,139,164 of Koffler and U.S. Pat. No. 3,221,848 of O'Neil, are made of rigid or semi-rigid shells that are connected together with a flexible folding portion. These types of bags are adapted to be hung from a closet door or the like upon being unfolded to provide access to articles of clothing stored therein. Rigid shell type garment bags, such as those disclosed in the above listed patents, serve little, if any, purpose after clothing and accessories have been removed from them. In addition, they tend to be heavy and bulky which makes them difficult to carry and to manage. This is a particular problem for the modern woman traveler who desires a lighter and more easily handled garment bag.

Flexible folding garment bags are illustrated in U.S. Pat. No. 4,244,453 of Herz and U.S. Pat. No. 3,115,959 of Jaffe. The Herz patent discloses a flexible garment bag adapted to be folded in the middle. It has a removable pouch for containing accessories which hangs from a conventional hanger within the garment bag. When this bag is unfolded and the clothes and pouch therein removed, the bag serves no further purpose. Articles carried in the bag must be removed and packed into drawers upon arrival and removed from the drawers and repacked into the bag upon departure.

The Jaffe patent discloses a garment bag having a front and rear compartment. While this garment bag is foldable, and has a handle provided for carrying, it can only be hung from a door or the like via the hangers on which the garments within the bag are hanging, the tops of which protrude from a hole provided in the top of the bag. After the garments and hangers are removed, the bag of Jaffe serves little purpose for temporary storage and access. In addition, hanging articles of clothing are stored for carrying in the front compartment while accessories such as neckties and shoes are stored in the rear compartment in flexible pouches. Access to the rear compartment is gained by unzipping a flap along the top and sides of the bag so that the flap falls out of the way revealing the interior of the rear compartment. Since there is no means of stowing the flap when it has been unzipped, it often falls to the floor where it may be stepped on or otherwise get in the way or even lost. In addition, if the bag is hanging with the front compartment accessible, a user who wishes to access the rear compartment must turn the bag around and rehang it.

These limitations of garment bags of the Jaffe type make them difficult to use for temporary storage. Articles transported in this type of bag must normally be removed from the bag, hung in closets or placed in chests of drawers, and the bag put away until time to repack it, at which time articles are removed from the drawers and repacked back in the bag. As any frequent traveler well knows, this is a tedious and time consuming task.

The problems associated with the prior art garment bags discussed above ar even more pronounced for the modern woman traveler. The woman traveler generally carries many more small articles than a man such as lingerie, shoes, and makeup. The process of unpacking these articles upon arrival at a hotel or motel and repacking them upon departure, necessitated by the prior art types of garment bags, is a particular burden for them. The more heavy and bulky the bag, the more difficult it is to handle, particularly for women.

Accordingly, it is to the provision of a garment bag that overcomes these problems and limitations that the present invention is primarily directed.

SUMMARY OF THE INVENTION

The present invention is a lightweight, foldable and versatile garment bag that may also serve as a wardrobe. It has a fastener adapted to hold the garment bag in a folded configuration and a handle or shoulder strap to facilitate hand carrying. A hanger is provided so that the garment bag may be unfolded and hung as from the top of a closet door to provide convenient access. A front panel of the bag has a flap that unzips around the top and sides of the bag to provide access to articles stored therein. The flap is adapted to be rolled into a compact bundle and stowed in the bottom of the garment bag so that it does not hang on the floor or otherwise get in the way as the flap hangs or becomes completely separated from the bag. In its rolled configuration the flap is releasibly held in the bottom of the garment bag by a strap which extends from the interior of the garment bag, over the top of the rolled flap and is releasibly fastened to the exterior of the garment bag.

The interior of the garment bag is provided with hanging means in a top end thereof for hanging garments such as suits, dresses, shirts and blouses. Attached to the inside of a back panel that partially bounds the interior of the garment bag are several pouches or pockets adapted to contain small articles of clothing, accessories and shoes. One of the pockets is releasibly attached so that it may serve as a removable satellite clothes bag. These pockets are accessible through an opening formed in the front panel when the flap is opened.

Thus, a lightweight, flexible, foldable garment bag is provided which may be unfolded, hung from the top of a closet door and then function as a wardrobe. Its front flap may be unzipped and compactly stored out of the way in the bottom of the garment bag. Articles of clothing and accessories stored in pockets within the garment bag then become easily accessible as the garment bag hangs so that it is not necessary to remove and place them in closets or drawers while traveling.

DETAILED DESCRIPTION

Figure 1:
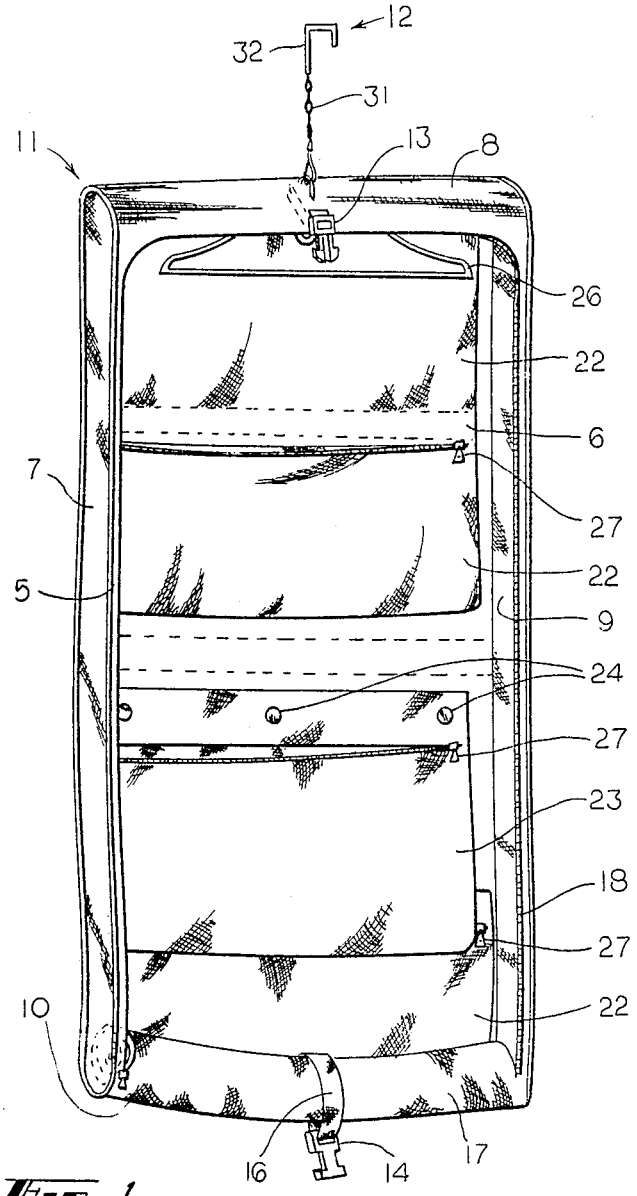
FIG. 1 is a perspective view of a garment bag embodying principles of the invention in a preferred form shown in an opened configuration.

Referring now in more detail to the drawings in which like numerals indicate like parts throughout the several views, FIG. 1 shows a garment bag 11, constructed in accordance with principles of the invention, as it appears in an unfolded, suspended configuration functioning as a wardrobe. The garment bag has a back panel 6, side panels 7, 8, 9 and 10 and a front panel that collectively define an enclosable compartment. The front panel is comprised of a peripheral portion 5 and a flap 17. The sides and top of the flap 17 are releasibly held to the peripheral portion 5 by a zipper 18 while the bottom of the flap merges unitarily with the peripheral portion. In FIG. 1 the flap 17 is shown unzipped, rolled into a compact bundle and stored in the bottom of the garment bag compartment. In the configuration of FIG. 1, side 8 serves as the top side of the garment bag while side 10 serves as its bottom side.

A female fastener element 14 is connected to bottom side 10 and a male fastener element 13 connected to the top side 8. A hook 32 is attached by a chain 31 to top side 8 to provide a means 12 for hanging the bag from an ancillary support. In FIG. 1, a strap 16 is shown extending over the rolled flap 17 and through the female fastener element 14 and connected, as will be discussed later, to the outside of the bottom side 10.

Permanently attached to the inside of the back panel 6 are two pockets 22, one above the other. Another pocket 23 is removably attached by snaps 24 to the back panel beneath the other pockets. Each of the pockets 22 and 23 has a zipper along its top.

Figure 2:
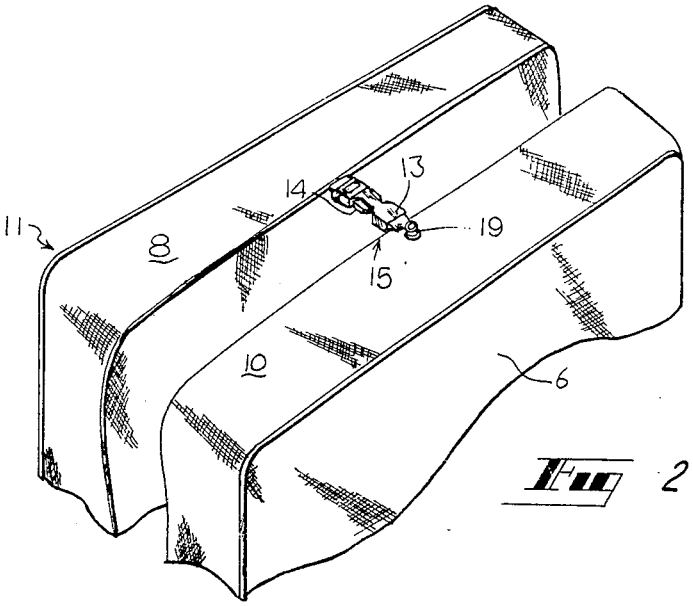
FIG. 2 is a perspective view of a portion of the garment bag shown illustrated in FIG. 1 shown held in a folded configuration.

FIG. 2 shows the ends of the garment bag 11 as they appear when the bag is folded for carrying. Of course here they are shown inverted, for clarity of explanation. The male fastener element 13, when latched to the female fastener element 14, forms the fastener generally indicated by 15. A snap 19 is attached to bottom side 10 laterally aligned with the male fastener element 14.

Figure 3:
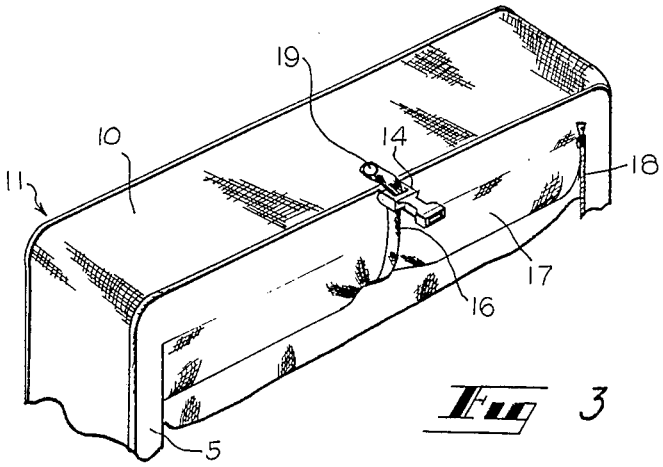
FIG. 3 is a perspective view of the bottom end of the bag with a bag flap held in a rolled-up configuration.

FIG. 3 shows the bottom end of garment bag 11 as it appears when flap 17 is rolled and stored in the bag. It is illustrated here invertedly and also reversed with respect to FIG. 2. Strap 16 is shown to extend over rolled flap 17, through the female fastener element 14 and connected at its end to the snap 19. Both the strap and fastener therefore are located along the lateral centerline of the bag. Furthermore, the female element is freely exposed so that it may be coupled with the male element in the event the user wishes to fold the bag with the flap unzipped to provide a double-wide but half as long compartment, for special purpose use.

Operation

FIG. 4 shows the garment bag 11 in its various configurations. FIG. 4A shows the bag folded and being carried by a shoulder strap 28 attached to the back of the panel 6. Alternatively, it may be hand carried by a handle mounted to the panel between the end of the shoulder strap. FIG. 4B shows the garment bag 11 hanging with the flap 17 zipped to the peripheral portion 5 of the front panel so that the bag compartment is closed. FIG. 4C shows the garment bag with flap 17 unzipped, rolled into a compact bundle and securely stored in the bottom of the bag. A dress is shown hanging within the garment bag compartment here in front of the bag pockets. FIG. 4D shows garment bag 11 as it appears with all hanging garments removed and with the pockets zipped closed.

A user of the garment bag 11 will typically place small articles such as lingerie and shoes into the pockets 22. Hung garments such as suits and dresses are placed on the hangers so that they are draped in front of the pockets within the bag compartment. When the bag has been packed the flap 17 is secured by zipping the zipper 18 around the sides and top of the front panel peripheral member 5. The garment bag is then folded so that the top and bottom sides of the bag are generally coplanar and the fastening means 15 is latched. The shoulder strap is then placed across the shoulder of a carrier so that the bag may be conveniently carried.

When a user of the garment bag reaches his or her temporary destination the fastener 15 is decoupled and the bag hung by the hanger means 12. Once access to its contents is desired the zipper 18 is unzipped which allows flap 17 to fall free and provide a large opening in the front panel. The flap is then rolled into a compact bundle and placed in the bottom of the bag upon side 10. Strap 16 is placed around the rolled flap 17, through an aperture in the female end 14 of the decoupled fastening means, and snapped to the snap 19.

Figure 4A:
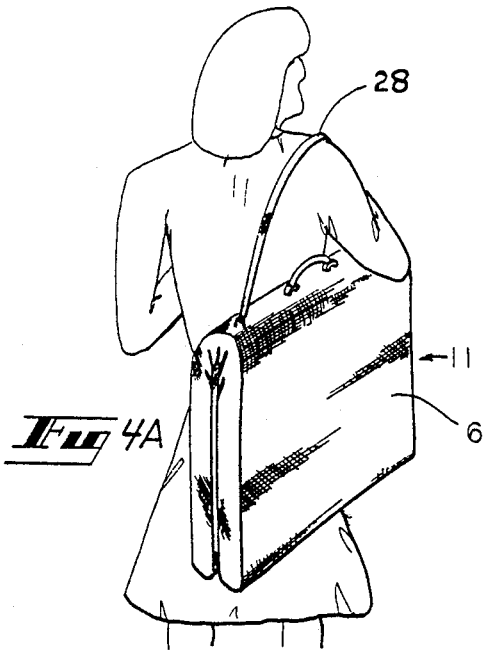
FIG. 4A is a perspective view of the garment bag in its folded configuration shown being carried.
Figure 4B:
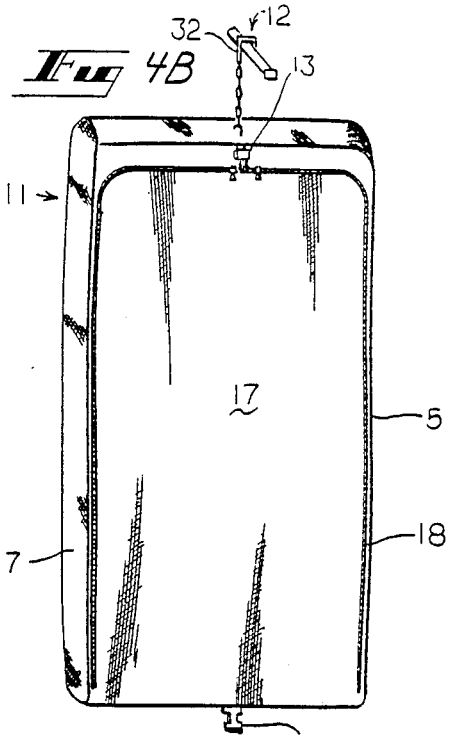
FIG. 4B is a perspective view of the garment bag in its unfolded, closed and hung configuration.
Figure 4C:
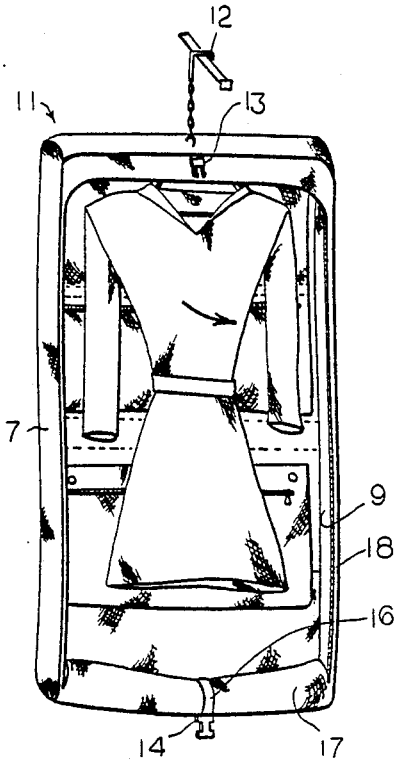
FIG. 4C is another perspective view of the bag similar to its FIG. 4B configuration but opened with a dress shown hung therein.
Figure 4D:
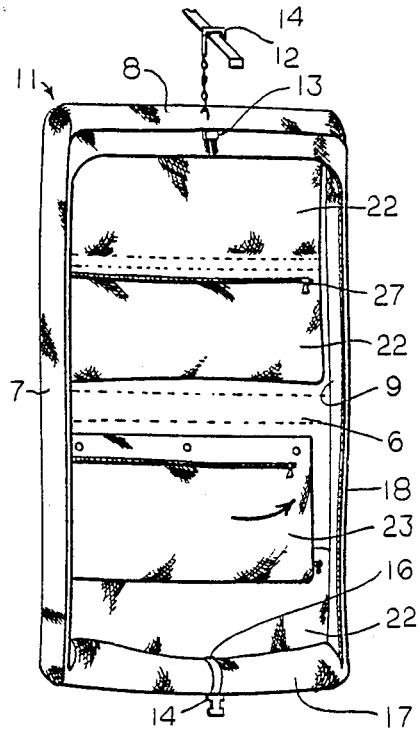
FIG. 4D is the same as FIG. 4C but with the dress shown removed.

With the garment bag 11 now configured as shown in FIG. 4C, the hanging articles may be removed and placed in a closet, if desired. Articles within the pockets 22 and pocket 23 are then easily accessed without having to remove them and place them in drawers for storage. Indeed, this is still largely true even if some draped garments remain hung inside the compartment. Pocket 23 may be used to collect dirty clothes and later temporarily removed. Alternatively, this pocket may be used to contain makeup to be carried to a vanity.

It thus is seen that a garment bag is now provided that is lightweight, versatile and easy to handle. It is foldable for carrying and may be opened and hung from an ancillary support to function as a wardrobe. Its access flap may be unzipped, rolled into a compact configuration and securely stored out of the way within the garment bag compartment. Clothes may be hung within the garment bag compartment and other articles such as lingerie, makeup and shoes stored in pockets within the garment bag where they are easily accessible and without having to be removed from the pockets and placed into drawers.

Although the invention has been described in the form of a preferred embodiment, many modifications, additions, and deletions may be made thereto without departing from the spirit and scope of the invention as set forth in the claims.

I claim:

1. A garment bag means for holding said flap portion in a bundled configuration adapted to be folded for carrying and unfolded for service as a wardrobe, and with the garment bag comprising flexible front and back panels joined by flexible side panels to define a compartment having a top portion and a bottom portion in a bag unfolded configuration; said front panel having a peripheral portion and a central flap portion adapted to be partially disconnected from said front panel peripheral portion by fastening means secured to said peripheral portion and said central flap portion to provide access to the compartment from ambiance; said flap portion being adapted to be rolled into a compact bundle for storage within said compartment bottom portion while partially disconnected from said front panel peripheral portion; means for holding said flap portion in a bundled configuration within the compartment bottom portion which comprises a strap having a first end and a second end, said first strap end being attached to the inside of one of said panels adjacent the compartment bottom portion and with said second strap end being releasibly fastened to the outside of one of said panels; hanger means for hanging garments within the compartment; and means for releasibly holding said side panels together to maintain the garment bag in a folded configuration.

2. A garment bag adapted to be folded for carrying and unfolded for service as a wardrobe, and with the garment bag comprising flexible front and back panels joined by flexible side panels to define a compartment having a top portion and a bottom portion in a bag unfolded configuration; said front panel having a peripheral portion and a central flap portion adapted to be partially disconnected from said front panel peripheral portion by fastening means secured to said peripheral portion and said central flap portion to provide access to the compartment from ambiance; said flap portion being adapted to be rolled into a compact bundle for storage within said compartment bottom portion while partially disconnected from said front panel peripheral portion; means for holding said flap portion in a bundled configuration within the compartment bottom portion which comprises a strap having a first end and a second end, said first strap end being attached to the inside of one of said panels adjacent the compartment bottom portion and with said second strap end being releasibly fastened to the outside of one of said panels; hangar means for hanging garments within the compartment; and means for releasibly holding said side panels together to maintian the garment bag in a folded configuration which comprises a first fastener means attached to one of said side panels and a second fastener means attached to another of said side panels, said first and said second fastener means being adapted to be releasibly coupled together when said garment bag is folded, and wherein said strap is aligned with and extendable through said first fastener means for holding the flap portion in a bundled configuration in the compartment bottom portion.

3. A garment bag adapted to be folded for hand carrying and unfolded for use as a wardrobe, and with the garment bag comprising a flexible front panel having an access opening, said front panel being joined by flexible sides to a flexible back panel to define a compartment, said front panel having a flap that may be configured so as to open and close said access opening, said back panel having a plurality of pockets on an interior side thereof accessible from within the compartment, said flap being adapted to be rolled into a compact bundle for storage within the compartment, means for holding said flap in a bundled configuration within said compartment which comprises a strap having a first end and a second end, said first end being attached to the inside of one of said panels adjacent a bottom portion of the compartment and said second end being adapted to be releasibly fastened to the outside of one of said panels adjacent the compartment bottom portion, said strap having a length sufficient to substantially surround said flap in its bundled configuration, and means for hanging garments within the compartment in a position overlaying said plurality of pockets.

4. A garment bag as defined in claim 3 wherein said pockets have zipper means along top edges thereof for securely containing articles within the pockets during transport of the garment bag, and further including means for releasible attachment of least one of said pockets to said back panel.

5. A garment bag as defined in claim 4 further comprising means for holding edges of two of said sides together to maintain the garment bag in a folded configuration, said holding means comprising a first fastener attached to one of said sides and a second fastener attached to another of said sides, said first and said second fastener being adapted to be releasibly coupled together when the garment bag is in a folded configuration.

6. A garment bag as defined in claim 5 wherein said first fastener has an aperture and wherein said strap is aligned with and extendable through said first fastener aperture for holding the flap in a bundled configuration.

* * * * *